US007174698B2

(12) United States Patent
Spatafora et al.

(10) Patent No.: US 7,174,698 B2
(45) Date of Patent: Feb. 13, 2007

(54) FOLDING METHOD AND DEVICE FOR CLOSING THE END OF A TUBULAR WRAPPING

(75) Inventors: Mario Spatafora, Granarolo (IT); Fabrizio Tale', Bologna (IT)

(73) Assignee: G.D Societa' per Azioni, Bologna (IT)

( * ) Notice: Subject to any disclaimer, the term of this patent is extended or adjusted under 35 U.S.C. 154(b) by 145 days.

(21) Appl. No.: 10/991,332

(22) Filed: Nov. 17, 2004

(65) Prior Publication Data

US 2005/0172581 A1 Aug. 11, 2005

(30) Foreign Application Priority Data

Nov. 21, 2003 (IT) ..... BO2003A0707

(51) Int. Cl.
*B65B 7/20* (2006.01)

(52) U.S. Cl. ..... 53/491; 53/377.2; 53/376.4; 493/183

(58) Field of Classification Search ..... 53/491, 53/230, 234, 372.2, 372.8, 376.4; 206/271, 206/273, 395; 493/183
See application file for complete search history.

(56) References Cited

U.S. PATENT DOCUMENTS 1,269,969 A * 6/1918 Smith ..... 53/234
2,383,664 A * 8/1945 Malhiot ..... 53/430
2,590,128 A * 3/1952 Sandberg ..... 53/463
2,674,400 A * 4/1954 Ross ..... 229/109
3,128,025 A * 4/1964 Buttery et al. ..... 225/48
4,995,223 A * 2/1991 Spatafora et al. ..... 53/176
5,946,884 A * 9/1999 Nordstrom et al. ..... 53/225
6,000,199 A 12/1999 Boldrini
D479,357 S * 9/2003 Focke et al. ..... D27/189

FOREIGN PATENT DOCUMENTS

| | | |
|---|---|---|
| CH | 158 681 | 11/1932 |
| EP | 0 344 674 | 12/1989 |
| GB | 426781 | 4/1935 |

* cited by examiner

*Primary Examiner*—John Sipos
(74) *Attorney, Agent, or Firm*—Ladas and Parry LLP

(57) ABSTRACT

A method and device for folding an end portion of a substantially elliptical-section, tubular wrapping for a group of cigarettes, whereby the end portion of the tubular wrapping is folded by forming three first and three second folded flaps located on opposite sides of a major axis of the elliptical section of the tubular wrapping; the first and second flaps being defined respectively by a respective central flap and by two respective lateral flaps, each of the second flaps being specular with a corresponding first flap, and being located between the major axis of the elliptical section and a packing wheel supporting the tubular wrapping; the first flaps being folded first, commencing with the first central flap; and the second flaps being folded subsequently, commencing with the second lateral flaps.

8 Claims, 5 Drawing Sheets

FOLDING METHOD AND DEVICE FOR CLOSING THE END OF A TUBULAR WRAPPING

The present invention relates to a folding method and device for closing the end of a tubular wrapping.

BACKGROUND OF THE INVENTION

More specifically, the present invention relates to a folding method and device for closing the end of a substantially elliptical-section, tubular wrapping for a group of cigarettes; the tubular wrapping being housed inside a radial conveying pocket of a packing wheel; said section having a major axis substantially parallel to a travelling direction of the relative pocket; the tubular wrapping having a longitudinal axis crosswise to said travelling direction and to said major axis, and comprising at least one end portion projecting from one end of said group; and the method comprising the steps of folding said end portion onto the relative end of said group to form three first and three second folded flaps located on opposite sides of said major axis; the first and the second flaps comprising a respective central flap and two respective lateral flaps; and each of said second flaps being specular with a corresponding said first flap, and being located between said major axis and said packing wheel.

To close the ends of tubular wrappings of the type described above, packing wheels are used comprising a number of conveying pockets, each housing a respective tubular wrapping positioned as described above, and each having a respective number of folding members fitted to the packing wheel.

The presence of the folding members obviously seriously complicates the structure, and so reduces the reliability, of the packing wheels.

SUMMARY OF THE INVENTION

It is an object of the present invention to provide a folding method designed to simplify the packing wheel structure as far as possible.

According to the present invention, there is provided a folding method for closing the end of a substantially elliptical-section, tubular wrapping for a group of cigarettes; the tubular wrapping being housed inside a radial conveying pocket of a packing wheel; said section having a major axis substantially parallel to a travelling direction of the relative pocket along an annular path; the tubular wrapping having a longitudinal axis crosswise to said travelling direction and to said major axis, and comprising at least one end portion projecting from one end of said group; and the method comprising the steps of folding said end portion onto the relative end of said group to form three first and three second folded flaps located on opposite sides of said major axis; the first and the second flaps comprising a respective central flap and two respective lateral flaps; and each of said second flaps being specular with a corresponding said first flap, and being located between said major axis and said packing wheel; and the method being characterized in that, to form said first and second folded flaps, the first flaps are folded first, commencing with the first central flap, and the second flaps are folded subsequently, commencing with the second lateral flaps.

According to the present invention, there is also provided a folding device for closing the end of a tubular wrapping for a group of cigarettes, the folding device comprising a packing wheel, in turn comprising at least one substantially radial conveying head fed by said packing wheel along an annular path in a given travelling direction; said conveying head comprising a conveying pocket for a respective said tubular wrapping and for a respective said group; said conveying pocket having a substantially elliptical cross section with a major axis substantially parallel to said travelling direction, having a longitudinal axis crosswise to said travelling direction and to said major axis, and housing a relative elliptical-section said tubular wrapping positioned parallel to said longitudinal axis and with at least one end portion of the tubular wrapping projecting from a relative end of the relative said group and of said conveying pocket; the folding device being characterized by also comprising first folding means located along said path and outwards of said packing wheel to fold a first portion of said end portion onto the relative end of said group to form three first flaps located outwards of said major axis with respect to said packing wheel and comprising a first central flap and two first lateral flaps; and second folding means located along said path, downstream from said first folding means in said travelling direction and outwards of said packing wheel, to fold a second portion of said end portion to form three second flaps located inwards of said major axis with respect to said packing wheel and comprising a second central flap and two second lateral flaps; said second flaps being specular with the corresponding first flaps with respect to said major axis.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
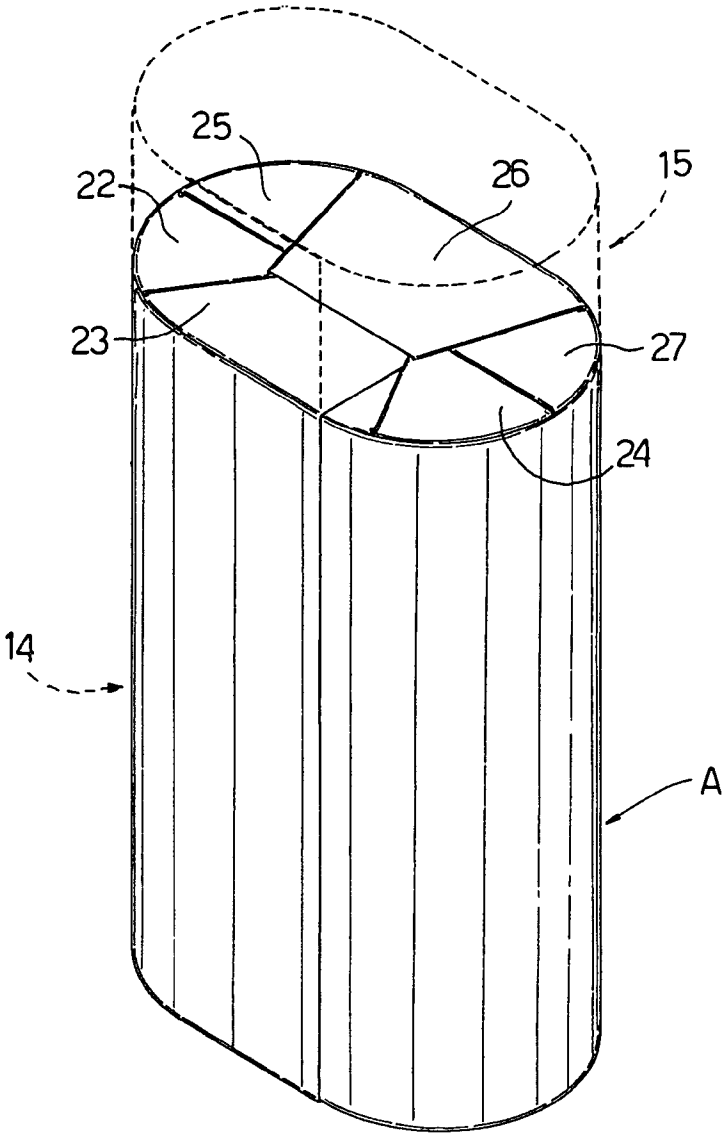
FIG. 1 shows an enlarged view in perspective of a wrapping obtained using the present invention.
Figure 10:
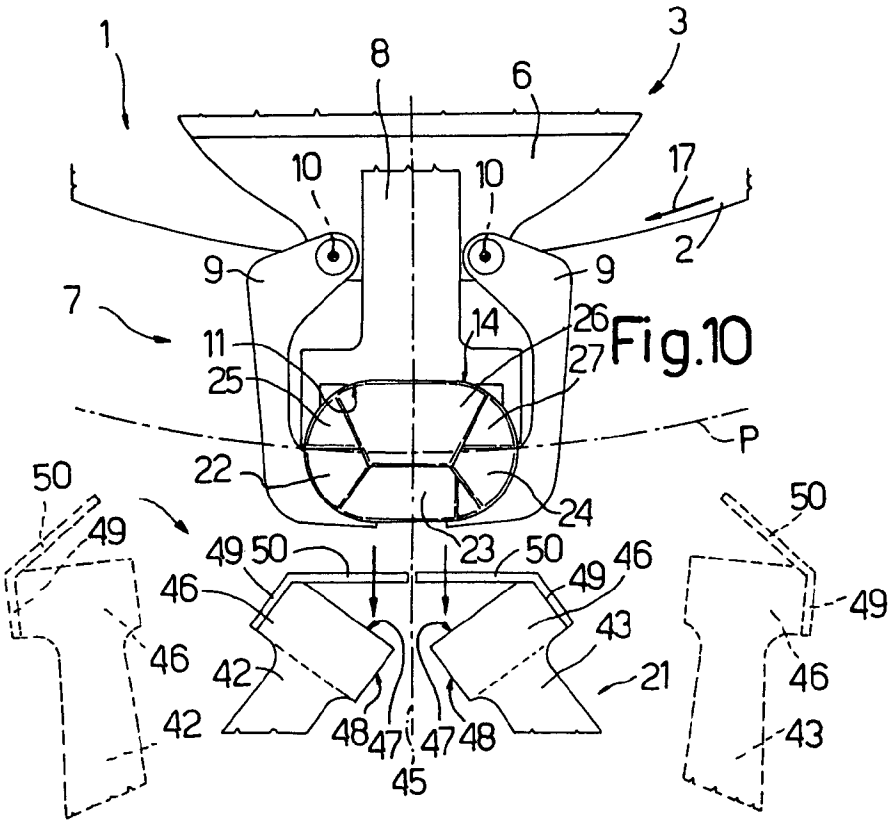
FIGS. 2 to 10 show partial, schematic views of a preferred embodiment of the folding device according to the present invention in respective operating positions.
Figure 3:
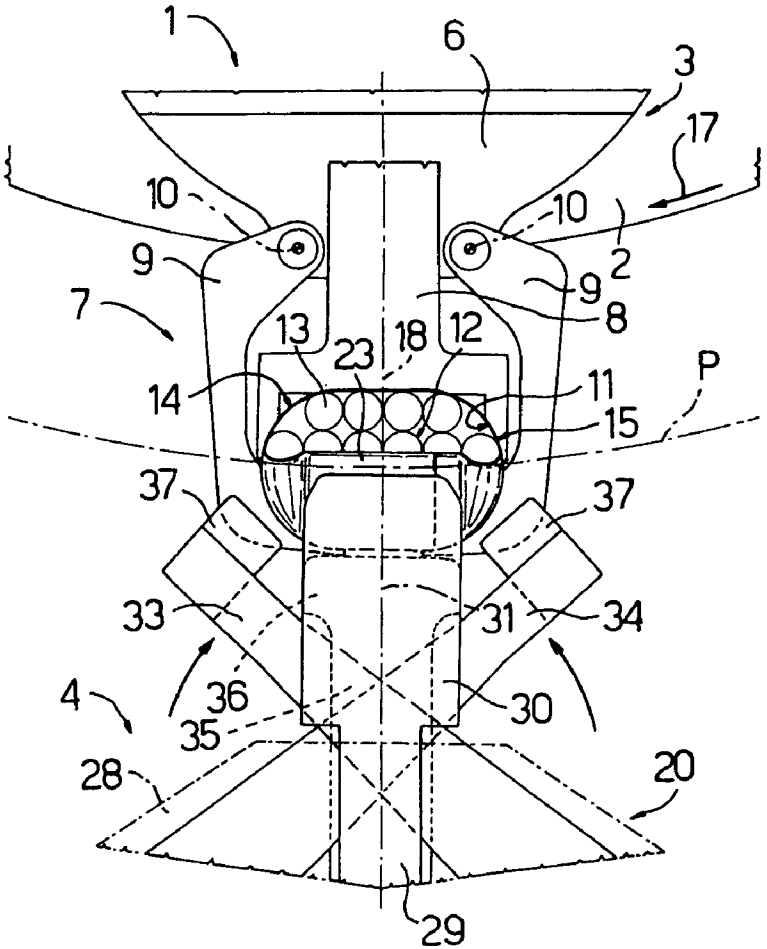

Number 1 in FIGS. 2 to 10 indicates as a whole a folding device comprising a packing wheel 2, which rotates about a respective axis (not shown) perpendicular to the FIG. 2-10 plane, and has a number of conveying heads 3 (only one shown) movable with packing wheel 2 along an annular path P extending through two folding stations 4 and 5 located successively along path P.

For the sake of simplicity, reference will be made in the following description to one conveying head 3 only.

Conveying head 3 comprises a plate 6 fitted to packing wheel 2 to oscillate, in known manner and with respect to packing wheel 2, about a respective axis (not shown) parallel to the axis (not shown) of packing wheel 2; and a conveying pocket 7, which is defined by a U-shaped supporting body 8 fitted radially to relative plate 6 with its concavity facing outwards of packing wheel 2, and by two arms 9 fitted to plate 6, on opposite sides of supporting body 8, to oscillate, with respect to plate 6 and about respective axes 10 parallel to the axis of rotation (not shown) of packing wheel 2, between an open position (not shown) and a closed position, in which both arms 9 cooperate with supporting body 8 to define a substantially elliptical-section seat 11 for a group 12 of cigarettes 13 housed parallel to axes 10 inside a tubular wrapping 14, at least one end portion 15 of which projects axially from a respective end of group 12. Tubular wrapping 14 also has a substantially elliptical section, and is housed inside conveying pocket 7 with a major axis 16 of its own section coincident with a major axis (hereinafter indicated by the same number) of the section of conveying pocket 7 and substantially parallel to a travelling direction 17 of conveying pocket 7 along path P; with a minor axis 18 of its own section coincident with a minor axis (hereinafter indicated by the same number) of the section of conveying pocket 7 and positioned substantially radially with respect to plate 6; and with its own longitudinal axis 19 perpendicular to travelling direction 17 and to the major axis 16 of its own section.

A folding unit 20 (FIGS. 2–5) and a folding unit 21 (FIGS. 6–10) are located at folding stations 4 and 5 respectively, and cooperate with end portion 15 of tubular wrapping 14 to fold end portion 15 onto a relative end of group 12 and so define a wrapping A by forming six flaps 22–27 (FIG. 1), of which, flaps 22–24 are located outwards of major axis 16 with respect to the axis of rotation (not shown) of packing wheel 2, and flaps 25–27 are located between major axis 16 and the axis of rotation (not shown) of packing wheel 2. With respect to major axis 16, each of flaps 22–24 is specular with a corresponding flap 25, 26, 27; flaps 22–24 comprise a central flap 23, and two lateral flaps 22 and 24 on opposite sides of central flap 23 and of minor axis 18; and flaps 25–27 comprise a central flap 26, and two lateral flaps 25 and 27 on opposite sides of central flap 26 and of minor axis 18.

With particular reference to FIGS. 2 to 5, folding unit 20 at folding station 4 comprises a supporting base 28 fitted with a central folding member 29, an end portion of which is defined by a substantially rectangular plate 30 lying in a plane perpendicular to longitudinal axis 19 of tubular wrapping 14, outwards of the plane defined by the relative end of group 12, and at a distance from said plane smaller than the length of end portion 15 of tubular wrapping 14. Plate 30 is of a width, crosswise to its major longitudinal axis 31, smaller than the length of major axis 16, and is movable—with respect to supporting base 28, in a direction 32 substantially radial with respect to packing wheel 2 and parallel to major longitudinal axis 31, and under the control of a known actuating device not shown—between a withdrawn rest position, in which plate 30 is located outwards of path P in a withdrawn position of non-interference with end portion 15 of tubular wrapping 14, and a forward work position, in which plate 30 interferes with end portion 15 while still remaining outwards of major axis 16.

Figure 2:
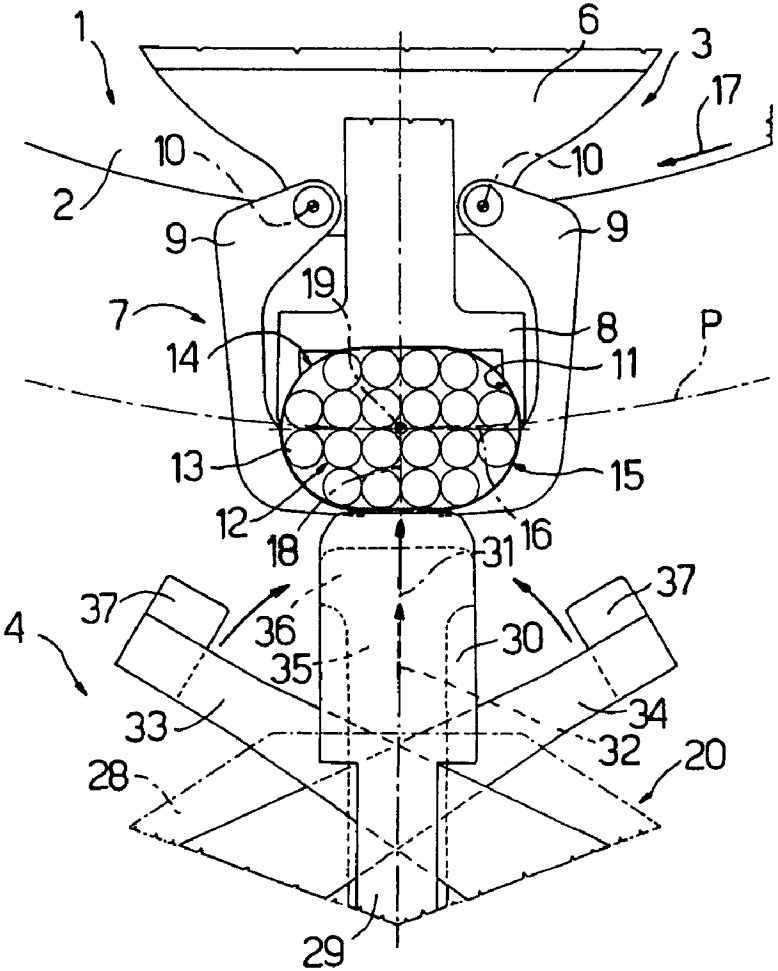

Supporting base 28 is also fitted with two folding arms 33, 34 and a contrast member 35, which, in a direction parallel to longitudinal axis 19, is located between central folding member 29 and conveying pocket 7, and in particular, with reference to the FIG. 2 plane, beneath plate 30 and substantially coplanar with the plane defined by the relative end of group 12. At the end facing packing wheel 2, contrast member 35 comprises an end portion defined by a plate 36 parallel to and of substantially the same width as plate 30. Contrast member 35 is fitted to supporting base 28 to move, in direction 32, between a withdrawn rest position and a forward work position substantially coincident with the withdrawn rest position and forward work position, respectively, of plate 30.

The two folding arms 33, 34 are fitted to base 28 specularly with respect to major longitudinal axis 31, cross over each other at a central portion located between plates 30 and 36, and have respective facing pads 37 on their free ends facing packing wheel 2. The two folding arms 33, 34 oscillate in opposite directions—with respect to base 28 and under the control of a known actuating device (not shown)—about respective axes (not shown) parallel to axes 10, to move respective pads 37 between an open position, in which pads 37 are located on opposite sides of central folding member 29, in a position of non-interference with end portion 15 of tubular wrapping 14, and a closed position, in which pads 37 interfere with end portion 15 and are positioned outwards of major axis 16 and, as explained clearly later on, overlapping plate 36 when contrast member 35 is in the forward work position.

Figure 6:
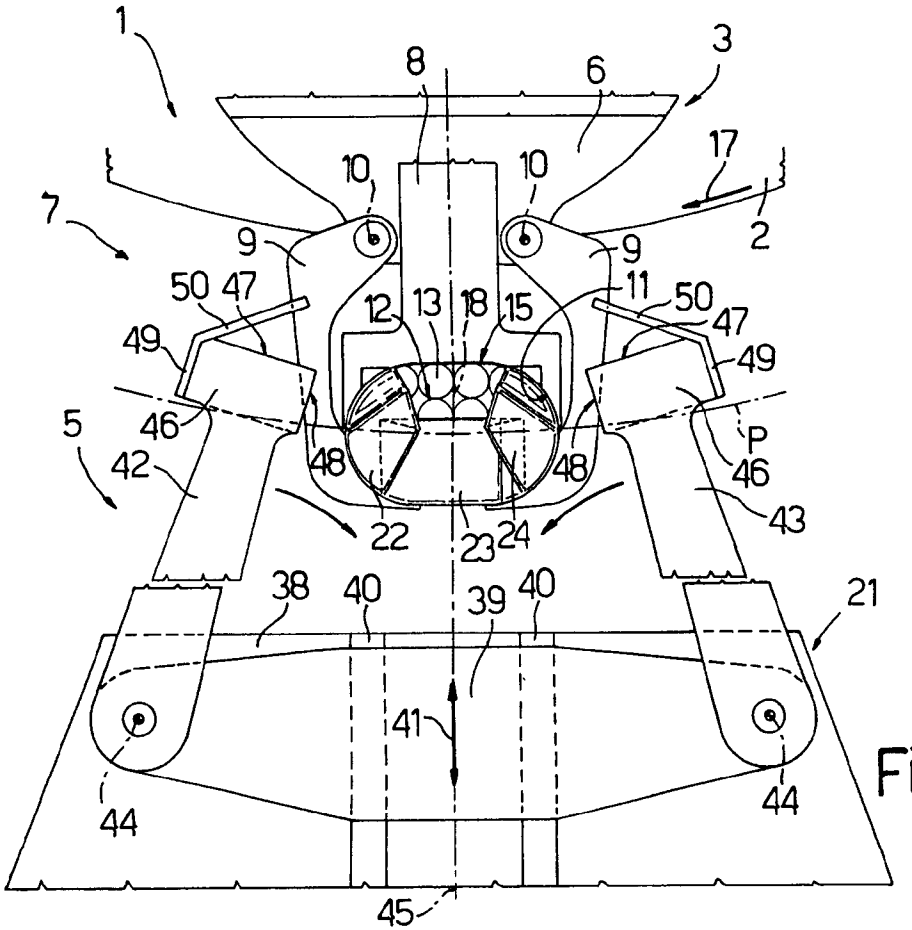
Figure 9:
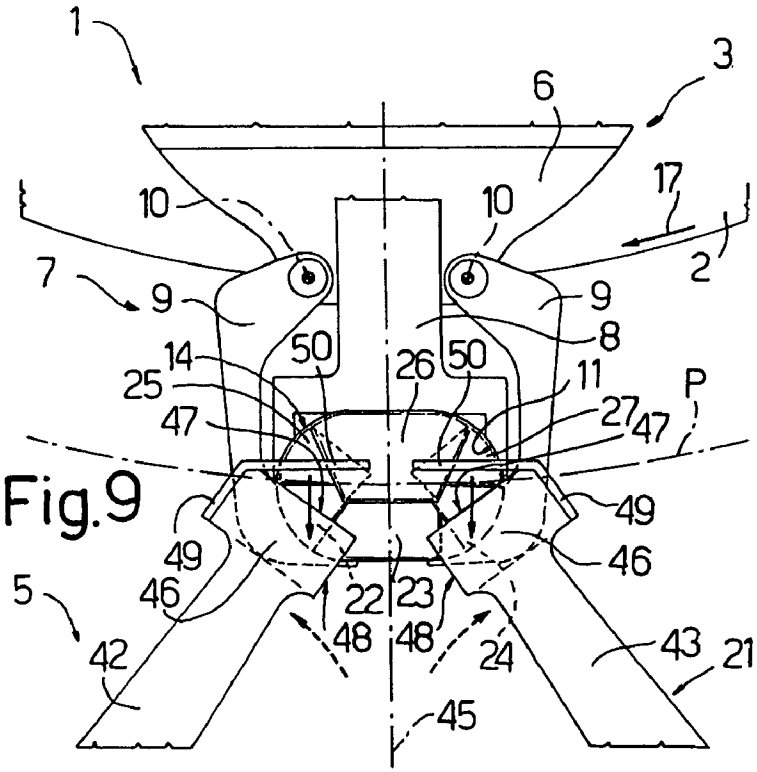
Figure 8:
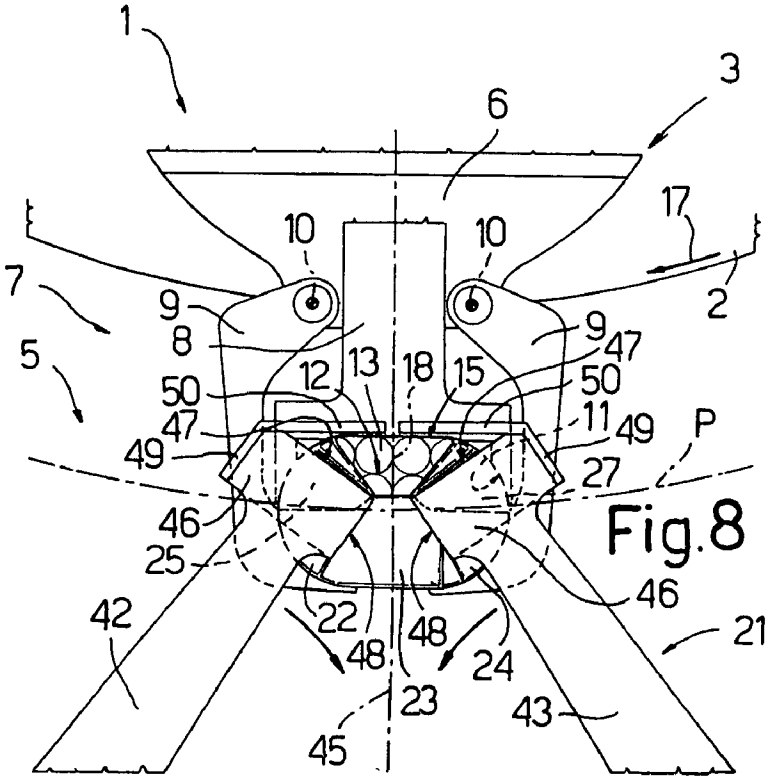

With reference to FIGS. 6 to 10, and particularly FIG. 6, folding unit 21 at folding station 5 comprises a supporting base 38 fitted with a carriage 39 powered to move, along guides 40 fitted to supporting base 38, in a substantially radial direction 41 with respect to packing wheel 2. Folding unit 21 also comprises two folding arms 42, 43 fitted to carriage 39 to oscillate in opposite directions—with respect to carriage 39 and under the control of known actuating devices (not shown)—about respective axes 44 parallel to axes 10. Folding arms 42, 43 are positioned specularly with respect to a central plane 45 perpendicular to the FIG. 6-10 plane and parallel to direction 41, extend towards packing wheel 2 from carriage 39, and each comprise an end head 46 substantially coplanar with folding arms 33, 34 and bounded laterally by a flat end surface 47 facing packing wheel 2, and by a flat surface 48 facing the other head 46 and forming a right dihedron with flat surface 47. On the opposite side to flat surface 48, each head 46 is fitted with a bracket 49, the end of which facing packing wheel 2 is connected to a plate 50 defined by a flat, substantially rectangular plate extending from relative head 46 towards packing wheel 2 and the other head 46, and forming a given angle—in the example shown, a roughly 35° angle—with relative flat surface 47.

By means of carriage 39, folding arms 42 and 43 are movable between a withdrawn position (shown by the dash line in FIG. 10), in which heads 46 are located outwards of path P in a position of non-interference with tubular wrapping 14, and a forward position (FIG. 6), in which heads 46 are located inwards of path P and between major axis 16 and a bottom wall of supporting body 8.

By moving folding arms 42 and 43 about axes 44, heads 46 are movable, in opposite directions with respect to central plane 45, between an open position (FIG. 6), in which heads 46 are separated by a distance greater than the length of major axis 16, and a closed position (FIG. 8), in which plates 50 are coplanar, and are positioned contacting each other and parallel to major axis 16.

Operation of folding device 1 will now be described with reference to one conveying pocket 7, and to one tubular wrapping 14 housed inside conveying pocket 7 with respective end portion 15 projecting from relative group 12 in a direction parallel to longitudinal axis 19.

Conveying pocket 7 is fed by packing wheel 2 along annular path P, and is positioned and maintained for a given length of time in a packing position, in which conveying pocket 7 faces folding unit 20, with minor axis 18 of tubular wrapping 14 aligned with major longitudinal axis 31 of plate 30, which is initially set to the withdrawn rest position (FIG. 2).

If packing wheel 2 rotates in steps, setting conveying pocket 7 to the above packing position poses no problem. If packing wheel 2 rotates continuously, however, conveying pocket 7 is maintained in the above packing position in known manner by oscillating conveying head 3 in known manner about the axis (not shown) of relative plate 6.

When plate 30 (FIG. 2) is subsequently moved in direction 32 from the withdrawn rest position to the forward work position, it engages and partly folds towards group 12 the central portion of end portion 15 located outwards of major axis 16. Given the distance between plate 30 and the plane defined by the respective end of group 12, the fold made by plate 30 does not result immediately in the formation of central flap 23, but simply pre-folds the portion of end portion 15 corresponding to flap 23, which is not formed until plate 36 of contrast member 35 is subsequently moved (FIG. 3) into the forward work position, before plate 30 is moved back into the withdrawn rest position.

Once plate 36 is moved into the forward work position, thus smoothing flap 23 onto the relative end of group 12 and keeping flap 23 in the folded position, folding arms 33 and 34 are moved towards each other, in a direction substantially parallel to said travelling direction 17 (FIGS. 3 and 4), into the closed position, engage respective portions of end portion 15 located between major axis 16 and flap 23, and form lateral flaps 22 and 24 by folding said portions (FIG. 4) onto group 12 so as to overlap flap 23 and plate 36.

Figure 5:
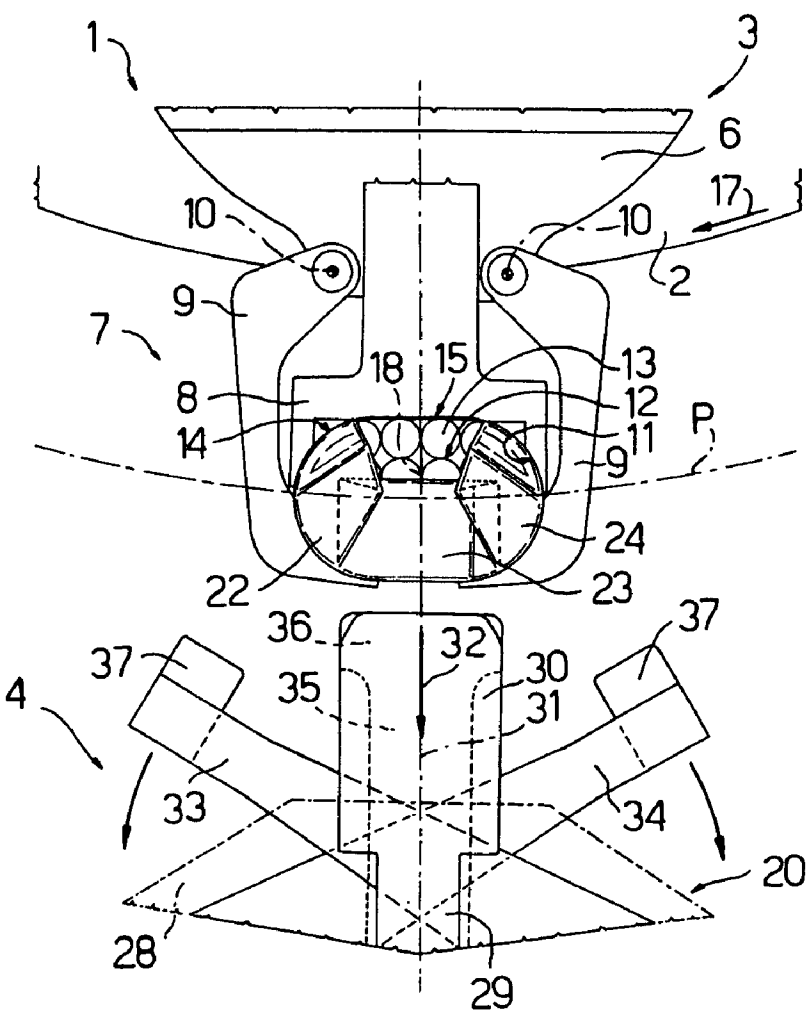
Figure 4:
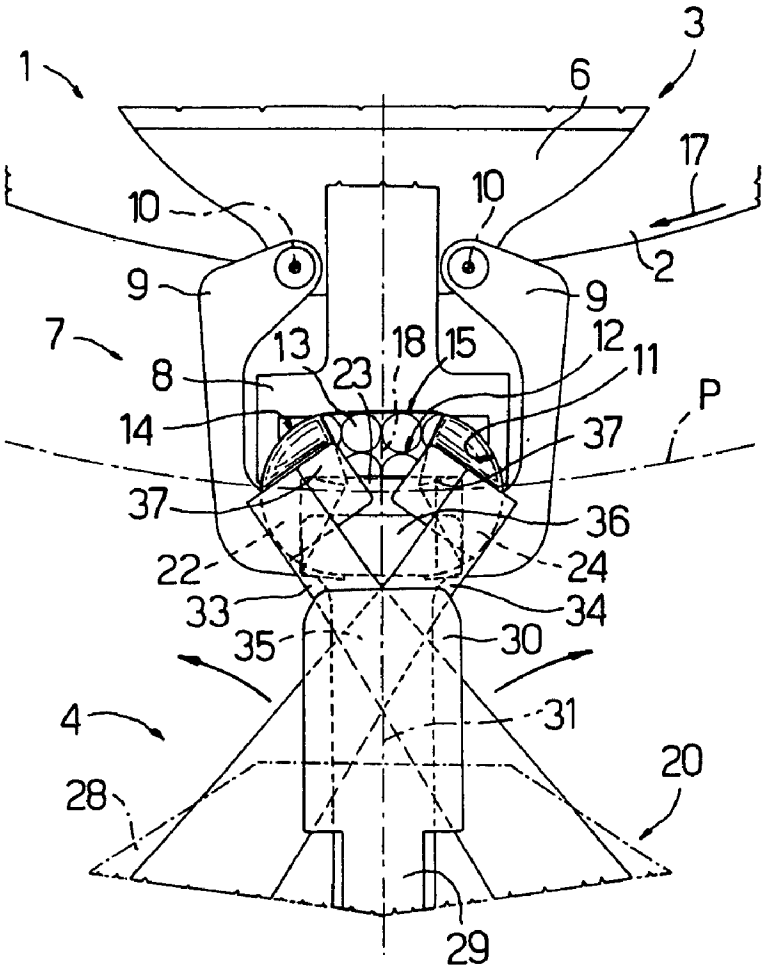
Figure 7:
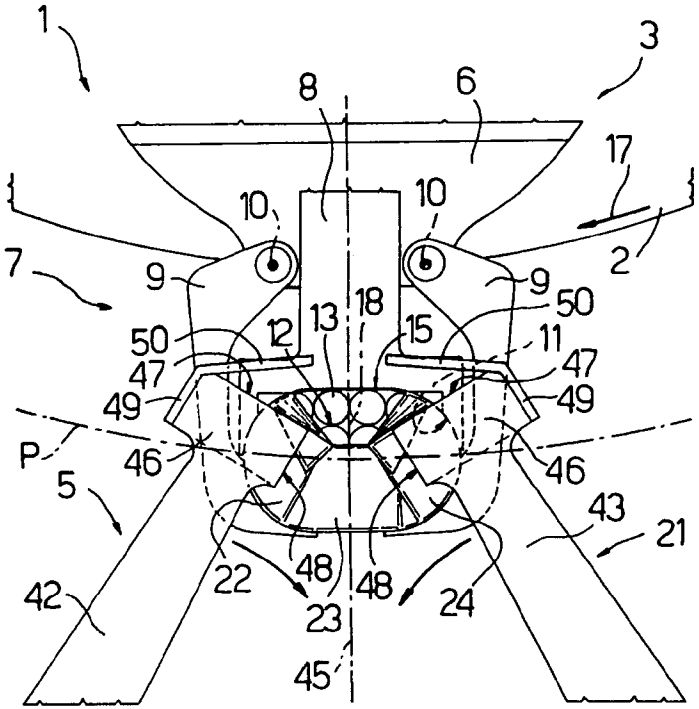

As shown in FIG. 5, once lateral flaps 22 and 24 are formed, plate 36 reverses into the withdrawn rest position, and folding arms 33 and 34 move back into the open position.

As conveying pocket 7 moves on to folding unit 21, flaps 22–24 are held folded down on group 12 by an external plate (not shown) extending, parallel to the travelling direction 17 of conveying pocket 7, along a portion of path P interposed between folding station 4 and folding station 5.

As shown in FIG. 6, on reaching folding station 5, conveying pocket 7 is positioned and maintained for a given length of time in a position facing folding unit 21, with minor axis 18 lying in central plane 45 of supporting base 38. When carriage 39 is moved towards packing wheel 2 in direction 41, folding arms 42 and 43 move from the withdrawn position (shown by the dash line in FIG. 10) to the forward position (FIG. 6), in which respective heads 46 are located on opposite sides of conveying pocket 7 and inwards of path P. When folding arms 42 and 43 are subsequently rotated about respective axes 44 into the closed position, surfaces 48 of respective heads 46 interfere with the portion of end portion 15 still to be folded (FIG. 7), thus forming respective lateral flaps 25 and 27, which are located on opposite sides of minor axis 18, inwards of major axis 16, and overlap corresponding lateral flaps 22 and 24 respectively.

When folding arms 42 and 43 are in the closed position (FIG. 8), plates 50 are positioned coplanar with each other, substantially contacting each other end to end, and interposed between the portion of end portion 15 still to be folded and the axis (not shown) of packing wheel 2. And, when carriage 39 is subsequently moved in direction 41 into the withdrawn rest position, plates 50 engage said portion of end portion 15 to form central flap 26 (FIGS. 9 and 10) and so complete closure of tubular wrapping 14.

In connection with the above, it should be pointed out that the folding time sequence described enables folding units 20 and 21 to be located in respective positions outside packing wheel 2, thus greatly simplifying the structure of packing wheel 2.

In fact, if folding units 20 and 21 were located outside packing wheel 2, and the portion of end portion 15 located between major axis 16 and the axis (not shown) of packing wheel 2, and corresponding in wrapping A to lateral flaps 25 and 27 and central flap 26, were to be folded first, as in the folding method normally adopted, it would obviously be extremely difficult to complete closure of the end of tubular wrapping 14, in that the portion of end portion 15 still to be folded, and corresponding in wrapping A to lateral flaps 22 and 24 and central flap 23, would prevent the folding members moving from the forward position inwards of major axis 16 to a work position radially outwards of conveying pocket 7.

The invention claimed is:

1. A folding method for closing the end of a substantially elliptical-section, tubular wrapping for a group (12) of cigarettes; the tubular wrapping (14) being housed inside a radial conveying pocket (7) of a packing wheel (2); said section having a major axis (16) substantially parallel to a travelling direction (17) of the relative pocket (7) along an annular path (P); the tubular wrapping (14) having a longitudinal axis (19) crosswise to said travelling direction (17) and to said major axis (16), and comprising at least one end portion (15) projecting from one end of said group (12); and the method comprising the steps of folding said end portion (15) onto the relative end of said group (12) to form three first (22, 23, 24) and three second (25, 26, 27) folded flaps located on opposite sides of said major axis (16); the first (22, 23, 24) and the second (25, 26, 27) flaps comprising a respective central flap (23) and two respective lateral flaps (22, 24); and each of said second flaps (25; 26; 27) being specular with a corresponding said first flap (22; 23; 24), and being located between said major axis (16) and said packing wheel (2); and the method being characterized in that, to form said first (22, 23, 24) and second (25, 26, 27) folded flaps, the first flaps (22, 23, 24) are folded first, commencing with the first central flap (23), and the second flaps (25, 26, 27) are folded subsequently, commencing with the second lateral flaps (25, 27).

2. A method as claimed in claim 1, wherein said first flaps (22, 23, 24) are folded by first folding means (28, 29, 33, 34, 35) located along said path (P) and outwards of said packing wheel (2); and said second flaps (25, 26, 27) are formed by second folding means (38, 42, 43) located along said path (P), downstream from said first folding means (28, 29, 33, 34, 35) in said travelling direction (17), and outwards of said packing wheel (2).

3. A method as claimed in claim 2, wherein said first folding means (28, 29, 33, 34, 35) comprise a first supporting base (28) located outwards of said packing wheel (2), a central folding member (29, 35), and two first lateral folding members (33, 34) fitted to said first supporting base (28) and on opposite sides of said central folding member (29, 35); said central folding member (29, 35) being moved with respect to said first supporting base (28) to form said first central flap (23), and said first lateral folding members (33, 34) being moved with respect to said first supporting base (28), and after the central folding member (29, 35), to form said two first lateral flaps (22, 24).

4. A method as claimed in claim 3, wherein said central folding member (29, 35) comprises a pre-folding member (29) and a contrast folding member (35), which are fitted to said first supporting base (28) and superimposed one over the other in a direction parallel to said longitudinal axis (19); said contrast folding member (35) being located, in said direction parallel to said longitudinal axis (19), between said pre-folding member (29) and said conveying pocket (7); and the method comprising, in succession, the steps of moving said pre-folding member (29) into a work position engaging said end portion (15) to pre-fold said first central flap (23); moving said contrast folding member (35), while keeping said pre-folding member (29) in the work position, into a work position engaging the pre-folded said first central flap (23) to complete folding of said first central flap (23); and withdrawing said pre-folding member (29) from the work position.

5. A method as claimed in claim 4, wherein said contrast folding member (35) is maintained in the work position during formation of said first lateral flaps (22, 24) by said first lateral folding members (33, 34).

6. A method as claimed in claim 2, wherein said second folding means (38, 42, 43) comprise a second supporting base (38) located outwards of said packing wheel (2), and two second lateral folding members (42, 43) fitted movably to said second supporting base (38); said second lateral flaps (25, 27) being folded by imparting to the second lateral folding members (42, 43) opposite first movements in a direction substantially parallel to said travelling direction (17); and said second central flap being folded by imparting to said second lateral folding members (42, 43) a common second movement in a direction (41) substantially crosswise to said travelling direction (17).

7. A method as claimed in claim 6, wherein said second lateral folding members (42, 43) comprise respective folding heads (46), and respective plates (50), each of which is integral with the respective folding head (46), extends from the relative folding head (46) towards said packing wheel (2) and towards the other folding head (46), and forms a given angle with the relative folding head (46); each said folding head (46) engaging said end portion (15) to form a respective said second lateral flap (25, 27) in the course of the relative said first movement; and said plates (50) cooperating with each other to form said second central flap (26) in the course of part of said common second movement.

8. A method as claimed in claim 7, wherein said part of the common second movement is a movement away from said packing wheel (2).

* * * * *